US007117768B1

(12) United States Patent
Stoeppelwerth

(10) Patent No.: US 7,117,768 B1
(45) Date of Patent: Oct. 10, 2006

(54) ADJUSTABLE WRENCH

(76) Inventor: Paul B. Stoeppelwerth, 9635 Autry Falls Dr., Alpharetta, GA (US) 30022

( * ) Notice: Subject to any disclaimer, the term of this patent is extended or adjusted under 35 U.S.C. 154(b) by 0 days.

(21) Appl. No.: 11/175,425

(22) Filed: Jul. 5, 2005

Related U.S. Application Data

(60) Provisional application No. 60/658,644, filed on Mar. 4, 2005.

(51) Int. Cl.
*B25B 13/24* (2006.01)

(52) U.S. Cl. ..... 81/133; 81/165

(58) Field of Classification Search ..... 81/132, 81/133, 155, 165, 167, 170
See application file for complete search history.

(56) References Cited

U.S. PATENT DOCUMENTS

| | | | | | |
|---|---|---|---|---|---|
| 157,968 | A | | 12/1874 | McFarland | |
| 1,228,850 | A | | 6/1917 | Upson | |
| 1,402,686 | A | * | 1/1922 | Trabold | 81/157 |
| 1,512,846 | A | | 10/1924 | Gumprecht | |
| 2,232,259 | A | | 2/1941 | Morgan | |
| 2,316,455 | A | * | 4/1943 | Richardson | 81/165 |
| 2,341,564 | A | | 2/1944 | Pierre | |
| 2,506,066 | A | | 5/1950 | Coates | |
| 2,687,662 | A | * | 8/1954 | Pugh | 81/165 |
| 2,714,323 | A | | 8/1955 | Lyons | |
| 2,719,449 | A | * | 10/1955 | Johnson | 81/165 |
| 4,326,436 | A | * | 4/1982 | McGraw | 81/165 |
| 5,301,576 | A | | 4/1994 | Nye | |
| 5,540,125 | A | | 7/1996 | Haskell | |
| 5,644,957 | A | | 7/1997 | Gustafson et al. | |
| 6,116,121 | A | | 9/2000 | Kitt, Jr. | |
| 6,789,451 | B1 | * | 9/2004 | Wu | 81/157 |

* cited by examiner

*Primary Examiner*—David B. Thomas
(74) *Attorney, Agent, or Firm*—Parks Knowlton LLC; Paul E. Knowlton

(57) ABSTRACT

An adjustable wrench 10 comprises a body 12 including a stationary jaw 22, an adjustable jaw 32, a recess 28 and a handle 27. A knurl 30 including a worm 42 is rotatably mounted on an axle 38 within recess 28. The adjustable jaw 32 includes a plurality of teeth 52 that mesh with worm 42 for driving the adjustable jaw 32 towards or away from stationary jaw 22. The adjustable wrench 10 further includes a receiving channel 52 formed at an angle to the knurl 30 within body 12. A means for braking 54 is inserted within the receiving channel 54 for removably engaging directly with worm 42 thus restricting the worm 42 from rotating and preventing the adjustable jaw 32 from moving. A means for locking 70, 76 is mounted on body 12 and interfaces with the means for braking 54 for preventing the means for braking 54 from moving. One embodiment of the means for braking 54 comprises a thumbwheel 58 and friction stop 60.

17 Claims, 3 Drawing Sheets

ADJUSTABLE WRENCH

CROSS-REFERENCE TO RELATED APPLICATION

This application claims priority to co-pending U.S. Provisional Application No. 60/658,644 filed on Mar. 4, 2005. The entire disclosure of that prior filed application is hereby incorporated by reference.

FIELD OF INVENTION

The present invention relates to the field of hand tools, and more specifically, to an adjustable wrench including a locking mechanism for keeping the adjustable jaw from slipping during use.

BACKGROUND OF THE INVENTION

Conventional adjustable wrenches generally include a stationary jaw integrally formed with a wrench body, an adjustable jaw that slides towards or away from the stationary jaw to span a space, and a knurl that when rotated moves the adjustable jaw to selectively narrow or widen the space for engaging various sizes of nuts and bolts. The adjustable jaw includes a plurality of teeth that mate with the knurl to create a worm gear drive that moves the adjustable jaw.

A perennial problem associated with adjustable wrenches is that the adjustable jaw of the wrench frequently slips during use and between uses. The adjustable jaw often slips when the adjustable wrench is rotated or twisted to loosen or tighten a nut or bolt. A related problem is that the knurl becomes loose and rotates slightly, causing the adjustable jaw to move and disengage the nut or bolt, thereby causing the nut or bolt to strip or become rounded. Thus, a user must constantly adjust the adjustable jaw of the wrench to maintain a secure hold on the nut or bolt. In some situations, pressure is constantly applied to the knurl by a user's thumb or finger so that the adjustable jaw does not slideably move outward. Many applications require the use of an adjustable wrench in areas where the nuts or bolts are not directly or easily accessible, making it difficult and inconvenient to constantly make the necessary adjustments.

Various known adjustable wrenches include braking mechanisms that prevent a knurl from rotating, thus restricting the movement of the adjustable jaw. These wrenches, however, include numerous intricate parts that must be machined to exact tolerances, which increases the retail, manufacturing, and production costs. Such wrenches also generally require a sequence of coordinated motions and the use of an additional tool for maneuvering the braking mechanism, making it difficult when attempting to access tight areas. In addition, many adjustable wrenches that include braking mechanisms do not include a means for locking the braking mechanism so as to restrict the slippage of the braking mechanism.

Accordingly, there remains in the art a need for an adjustable wrench that provides an adjustable braking mechanism for locking an adjustable jaw in a fixed position, where the adjustable wrench is inexpensive and easy to manufacture. There is also a need for an adjustable wrench that includes a locking mechanism for selectively locking the braking mechanism in place, thereby restricting the braking mechanism from moving and as a result, preventing the adjustable jaw from sliding.

SUMMARY OF THE INVENTION

The present invention overcomes the deficiencies of the known art and the problems that remain unsolved by providing an adjustable wrench that includes a braking mechanism formed at an angle to a knurl within the body of the adjustable wrench, for securely holding a worm of a knurl in place, thus preventing an adjustable jaw from slipping. The braking mechanism is easily engaged by a thumb or finger of a user. The adjustable wrench includes a locking feature that interfaces with the braking mechanism for preventing the braking mechanism from moving once engaged with the worm.

In accordance with one embodiment of the present invention, there is provided an adjustable wrench comprising a stationary jaw integrally formed with a body, the body including a recess and a handle, a knurl including a worm, the knurl being rotatably mounted on an axle within the recess, an adjustable jaw including a plurality of teeth meshing with the worm, where rotation of the knurl imparts movement to the adjustable jaw, a receiving channel formed at an angle to the knurl, the receiving channel extending within the body and into the recess, and a means for braking inserted within the receiving channel, and removably engaging with the worm for restricting the worm from moving.

Regarding the embodiments described herein, as well as those covered by the claims, the means for braking may include a machine screw having a thumbwheel and a friction stop. The friction stop may include a material having a sufficient coefficient of friction for securely engaging with the worm. Advantageously, the friction stop includes a diameter that is slightly larger then the diameter of the machine screw and the diameter of the receiving channel, for preventing the machine screw from falling out of the receiving channel. In addition, the adjustable wrench includes a means for locking mounted on the body of the wrench and interfacing with the thumbwheel for preventing the thumbwheel from rotating. In one non-limiting example, the means for locking may include a slideable switch that removably interfaces with a circular groove formed in the bottom surface of the thumbwheel. Advantageously, the means for braking and the means for locking is maneuvered easily with a user's thumb or finger. The adjustable wrench may include other means for braking and other means for locking without departing from the scope of the claims. In addition, the adjustable wrench may or may not include markings or indicators, for indicating to a user the measurement of the distance between the stationary jaw and the adjustable jaw, where the measurement is in standard or metric size and corresponds to the size of a nut or bolt.

In a further embodiment of the present invention, there is provided an adjustable wrench comprising a body including a stationary jaw, a recess, a handle and a knurl including a worm, the knurl being rotatably mounted on an axle within the recess, an adjustable jaw including a plurality of teeth engaging with the worm where rotation of the knurl imparts movement to the adjustable jaw, a threaded channel formed at an angle to the knurl, the threaded channel extending through one side of the body into the recess, a screw inserted within the threaded channel, the screw removably engaging with the worm for restricting the worm from moving, and a lock selectively engaged with the screw for restricting the screw from rotating. Regarding the embodiments described herein, as well as those covered by the claims, the adjustable wrench may include a threaded channel that is formed at an angle to the worm or extends within the body of the wrench in different positions including a straight, vertical, diagonal or horizontal position. Advantageously, the thumbwheel may include ridges that provide traction for securely grasping the thumbwheel.

DETAILED DESCRIPTION

As required, detailed embodiments of the present invention are disclosed herein. It will be understood that the disclosed embodiments are merely exemplary of the invention that may be embodied in various and alternative forms. The figures are not necessarily to scale, and some features may be exaggerated or minimized to show details of particular components. In other instances, well-known materials or methods have not been described in detail in order to avoid obscuring the present invention. Therefore, specific structural and functional details disclosed herein are not limiting but serve as a basis for the claims and for teaching one skilled in the art to variously employ the present invention.

As used herein, the words and terms "brake", "means for braking", "lock", and "means for locking", as well as all derivatives, are defined interchangeably to include all devices or parts thereof that hook, catch, grasp, latch, bolt, bar, hasp, clinch, bond, fasten, padlock, clamp, clasp, link, grip, key, freeze, check, hamper, curb, deter, damper, hinder, retard, govern, limit, immobilize, and the like.

Figure 1:
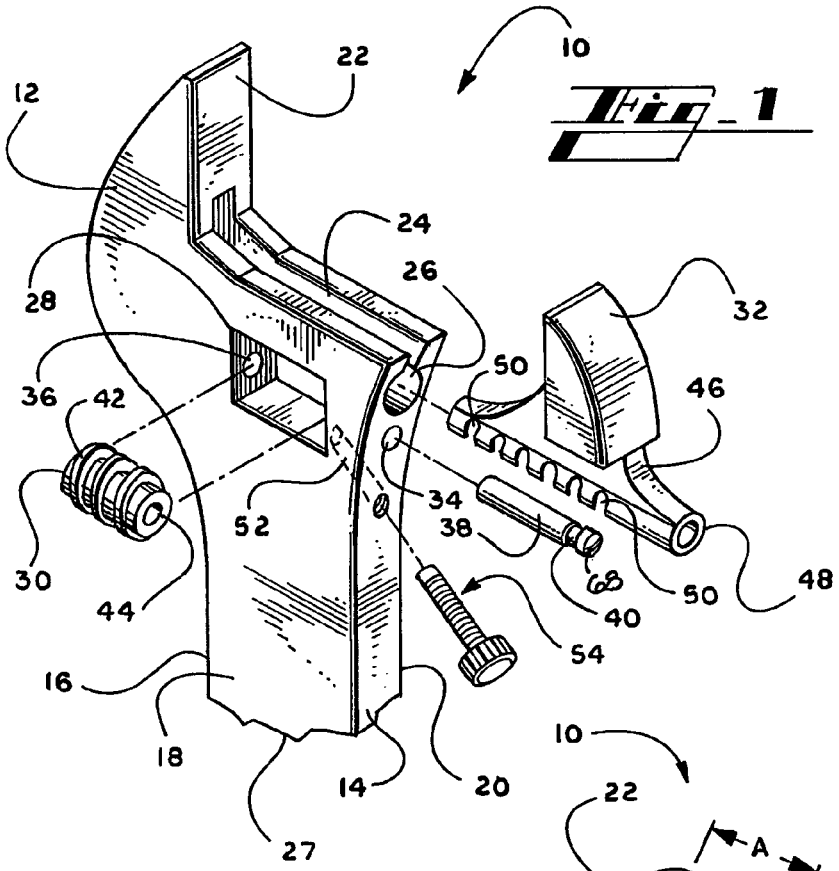
FIG. 1 is an exploded view of an embodiment of an adjustable wrench, according to the present invention.

Referring now to the drawings, wherein like elements are represented by like numerals throughout, there is shown in FIG. 1 an exploded view of an adjustable wrench 10 according to the present invention. The adjustable wrench 10 includes a wrench body 12 having a first side 14, a second side 16, a front 18, a back 20, and a stationary jaw 22 that is integrally formed with the wrench body 12. The adjustable wrench 10 further includes a guideway 24 interfacing with a guide aperture 26 and a recess 28. As shown, recess 28 is formed completely through the wrench body 12 and is dimensioned to rotatably receive a knurl 30. In addition, the adjustable wrench 10 includes a handle 27, an adjustable jaw 32, and an axle channel 34. The axle channel 34 extends within wrench body 12 and into recess 28. The axle channel 34 correspondingly aligns with an axle hole 36 that is formed within recess 28. The axle channel 34 may comprise a standard hole having a tapped end or a drilled tapped hole including a plurality of threads for threadably receiving an axle 38. The axle hole 36 is sized to receive one end of axle 38. The axle 38 includes a plurality of axle threads 40 that can be formed on the entire length of axle 38 or alternatively formed on one or both ends of axle 38. The knurl 30 includes a worm 42 and a knurl aperture 44. The knurl 30 may comprise a standard knurl, or a standard knurl including a knurl extension where the knurl extension does not include worm 42. The knurl extension may be integrally formed at one end of knurl 34 or comprise a separate sleeve that is axially coupled to knurl 30.

The adjustable jaw 32 includes a jaw wall 46 that is integrally formed with a guide rod 48. The guide rod 48 is dimensioned to slide into guide aperture 26 so that the jaw wall 46 correspondingly slides within guideway 24. Guide rod 48 includes a plurality of jaw teeth 50 that correspondingly mesh with worm 42 of knurl 30 forming a worm gear drive. Rotating knurl 30 imparts movement of the adjustable jaw 32 towards or away from stationary jaw 22. Although in the exemplary embodiment the adjustable jaw 32 comprises a similar height, depth, width, or shape of stationary jaw 22, it will be understood that the adjustable jaw 32 may comprise different dimensions, geometric sizes and/or shapes then that of stationary jaw 22. In addition, the plurality of teeth 50 may be configured closer together or father apart from each other depending on the degree of movement desired of adjustable jaw 32.

The adjustable wrench 10 further includes a receiving channel 52 for receiving a means for braking 54, as described below. The receiving channel 52 is formed at an angle to knurl 30 within body 12. As shown in FIG. 1, the receiving channel 52 extends from a first side 14 of the wrench body 12 and diagonally terminates within recess 28. Alternatively, the receiving channel 52 may be formed within any side or surface of wrench body 12. For example, the receiving channel 52 may extend within the second side 16 of the wrench body 12, or in both the first side 14 and the second side 16 of the wrench body 12, thereby providing for at least two receiving channels 52, where each receiving channel 52 correspondingly receives a means for braking 54. Alternatively, the receiving channel 52 may be formed within the wrench body 12 in any configuration or position including a vertical or horizontal position. The receiving channel 52 may comprise a drilled tapped hole including a plurality of threads or a standard hole including a tapped end. The hole formed by the receiving channel 52 comprises a diameter that receivingly corresponds with the diameter of the means for braking 54.

Figure 2A:
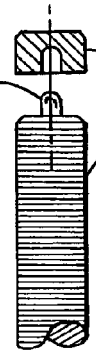
FIG. 2*a* is an enlarged view of a stop, according to one embodiment of the present invention.
Figure 2:
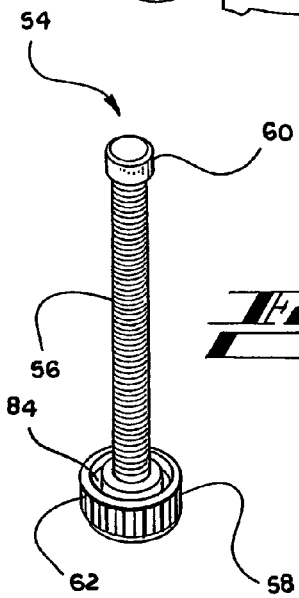
FIG. 2 shows a means for braking, according to one embodiment of the present invention.

Referring to FIG. 2 there is shown a means for braking 54. In the exemplary embodiment, the means for braking 54 comprises a threaded machine screw 56 including a thumbwheel 58 at one end and a friction stop 60 at the distal end. The means for braking 54 may or may not include a friction stop 60. Thumbwheel 58 is dimensioned thin and small to eliminate potential interference when using the adjustable wrench 10 in tight or difficult areas. However, it will be understood that thumbwheel 58 may comprise a variety of different designs, dimensions, sizes or shapes. Thumbwheel 58 can also include ridges 62 formed on the external surface of the thumbwheel 58 for providing traction to easily grasp and rotate thumbwheel 58 with a user's thumb and/or finger.

The machine screw 56 may comprise any suitable diameter, shape, and length but should be long enough to extend through receiving channel 52 to make contact with worm 42 or knurl 30. In one non-limiting example, the machine screw 56 can be 5/64" for an 8 inch adjustable wrench or 3/32" for larger adjustable wrenches. The machine screw 56 may comprise brass, steel, metal, hard plastic, aluminum, or any combination thereof.

It will be noted that a means for breaking 54 may include a moveable piece located at any position on or within the adjustable wrench 10 that, when moved into a braking position, interfaces with either the knurl 30, the worm 42, or a knurl extension. Some non-limiting examples of a means for breaking 54 may comprise a slideable bar, levers, spring loaded pins, rods, shafts, locking bearings, adjustable stops, screws, bolts, cams, detents, and the like.

Alternatively, the means for braking 54 may comprise a means for engaged braking that is positioned within receiving channel 52. The means for engaged breaking may key into or otherwise positively engage with knurl 30, worm 42 or a knurl extension by being received in a recess such as a slot or groove that is formed within the knurl 30, worm 42 or knurl extension. Some examples of a means for engaged breaking includes a mechanical device such as, a rod, a shaft, a pin, couple, detent or yoke.

FIG. 2*a* shows an enlarged view of a friction stop 60, removably attached to the end of a machine screw 56. The friction stop 60 may include a material having a sufficient coefficient of friction for firmly engaging with knurl 30 or worm 42, for immobilizing knurl 30 and preventing adjustable jaw 32 from moving. Some common examples of materials having a sufficient coefficient of friction include hard rubber, hard plastic, low carbon steel, high carbon steel, or any combination thereof.

One example of a friction stop 60 is a hard rubber cap 64. The hard rubber cap 64 may include a hole for receiving a screw knob 66 that is formed on one end of machine screw 56. In addition, the hard rubber cap 64 may be configured to include a diameter that is slightly larger then the diameter of the machine screw 56 and the diameter of the receiving channel 52, preventing the machine screw 56 from sliding out of or being removed from receiving channel 52.

Figure 2B:
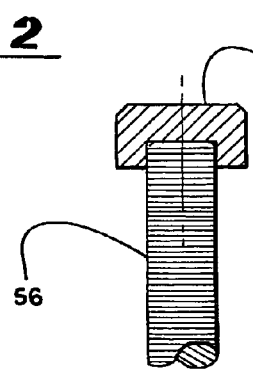
FIG. 2*b* is an enlarged cross-section view of stop, according to an alternative embodiment of the present invention.

FIG. 2*b* shows an enlarged cross-sectional view of a friction stop 60 according to an alternative embodiment of the present invention. Here, the friction stop 60 comprises a threaded screw cap 65. As illustrated, the threaded screw cap 65 is threadably inserted onto one end of machine screw 56. Again, the threaded screw cap 65 may be dimensioned to be slightly wider then the diameter of the machine screw 56 and the receiving channel 52, to prevent the machine screw 56 from slipping out of or being removed from receiving channel 52.

Some other examples of a friction stop 60 may include a crimped cap that is crimped onto one end of machine screw 56, a screw cap including a threaded shaft that is threadably inserted into a threaded recess that is formed within machine screw 56, a threaded nut, or any other suitable device that can be either removably attached to or permanently affixed to one end of machine screw 56 and dimensioned to prevent the machine screw 56 from falling out of receiving channel 54.

Figure 3:
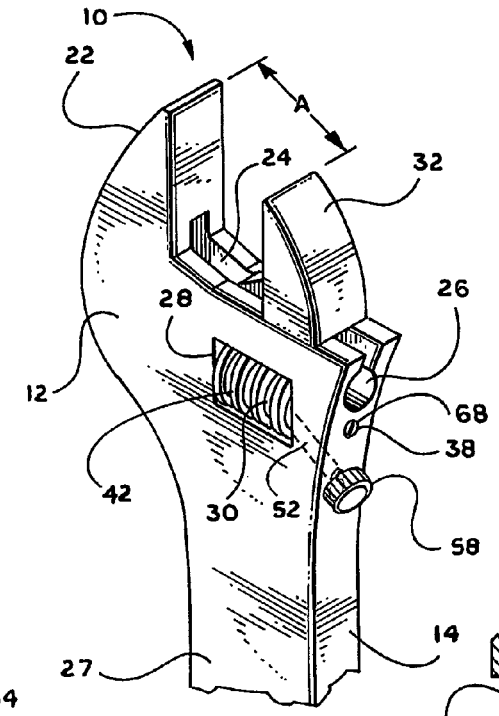
FIG. 3 is an isometric view of the assembled adjustable wrench of FIG. 1.

Referring now to FIG. 3, with a view to FIG. 1, there is shown an isometric view of an assembled adjustable wrench 10 according to an embodiment of the present invention. The guide rod 48 of the adjustable jaw 32 is slideably engaged within guideway 24. The knurl 30 is inserted within recess 28 so that the knurl aperture 44 correspondingly aligns with the axle channel 34 and the axle hole 36. The knurl 30 is positioned within recess 28 so that the jaw teeth 50 of adjustable jaw 32 correspondingly mesh with the worm 42 on knurl 32, forming a worm gear drive. axle 38 is inserted within the axle channel 34 and the knurl aperture 44. Axle 38 is threadably fastened within axle channel 34 so that one end of axle 38 firmly fits within axle recess 36, thereby rotatably mounting knurl 32 within recess 28. Axle 38 may include an axle groove 68 for inserting a tool, such as a screwdriver, for securely tightening axle 38 within axle channel 34.

A means for breaking 54 is threadably inserted within receiving channel 52. Friction stop 60 is subsequently attached to one end, opposite thumbwheel 58. Threadably inserting a means for braking 54 within a receiving channel 52, which is formed at an oblique angle to knurl 30, provides the ability to exert a precise amount of pressure that is diagonally distributed against the worm 42 or knurl 30. The force generated by the means for breaking 54 drives the knurl 30 both normal and parallel to axle 38, thereby forcing worm 42 to press against corresponding jaw teeth 50 in two directions. This compound force reduces or eliminates the slippage or play within adjustable jaw 32.

In use, knurl 30 is rotated clockwise or counterclockwise so that worm 42 drives the adjustable jaw 32 towards or away from stationary jaw 22, to define space A. Space A is sized accordingly to accommodate various sizes of nuts and bolts. Once a desired space A is selected, thumbwheel 58 of the means for braking 54 is subsequently rotated to engage friction stop 60 against worm 42, thereby restricting knurl 30 from rotating and preventing the adjustable jaw 32 from slipping. Space A may be adjusted from a minimum width of zero, where the stationary jaw 22 and adjustable jaw 32 are locked together face-to-face, to a maximum width that is determined by the number of jaw teeth 50 and size of the adjustable wrench 10. Advantageously, the means for braking 54 allows a user to selectively lock the adjustable jaw 32 in place. To move the adjustable jaw 32, thumbwheel 58 is subsequently rotated to allow the friction stop 60 of the means for braking 54 to disengage with worm 42 permitting knurl 42 to rotate.

Figure 4:
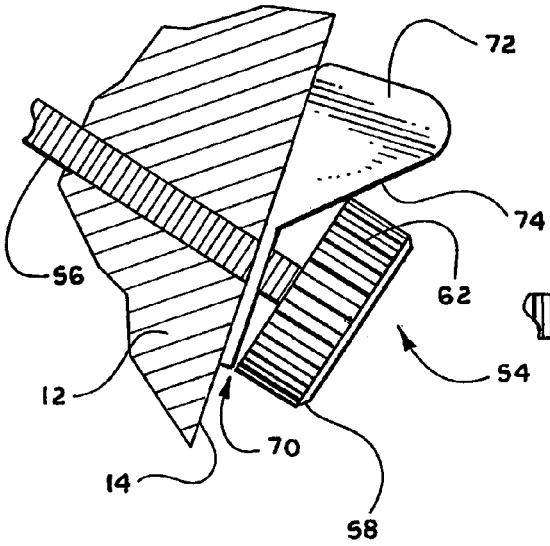
FIG. 4 shows a means for locking, according to one embodiment of the present invention.

Referring now to FIG. 4, there is a means for locking 70 according to one embodiment of the present invention. The means for locking 70 includes a lock wedge 72 mounted on wrench body 12 and coupled to the means for braking 54. The lock wedge 72 may comprise a plastic, metal, aluminum, or brass material, or any combination thereof.

When locking the means for braking 54, lock wedge 72 is moved so that one edge 74 of the lock wedge 72 interfaces with thumbwheel 58, thereby preventing thumbwheel 58 from rotating. To rotate thumbwheel 58, lock wedge 72 is subsequently moved in an unlocked position away from thumbwheel 58 so that edge 74 is no longer in contact with thumbwheel 58. Thumbwheel 58 may include a groove or recess for receiving the edge 74 for selectively locking the means for braking 54 in certain rotational positions. The means for locking 70 is designed and configured to allow a user to easily maneuver the means for locking 70 with a thumb or finger. It will be understood that lock wedge 72 may be configured to slide, rotate, swing, or bend in association with thumbwheel 58.

Figure 6:
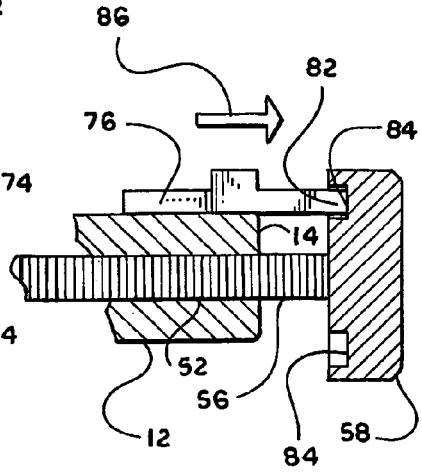
FIG. 6 is a side view of a means for locking shown in a locked position, according to the alternative embodiment of the present invention.
Figure 5:
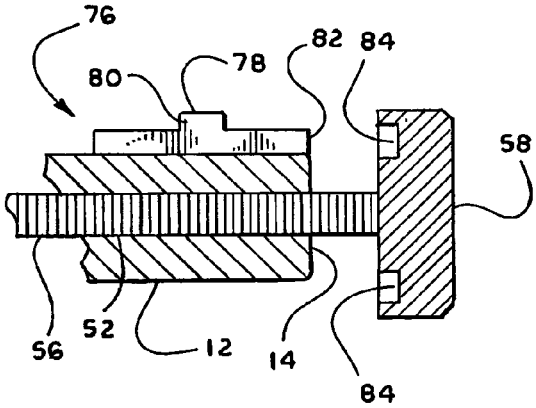
FIG. 5 is a side view of a means for locking shown in an unlocked position, according to an alternative embodiment of the present invention.

Referring to FIGS. 5 and 6 there is shown a means for locking 76 according to an alternative embodiment of the present invention. As illustrated in FIG. 5, the illustrated means for braking 54 is threadably inserted within receiving channel 52. In this exemplary embodiment, the means for locking includes a switch lock 76 that is mounted on wrench body 12 and shown here in an unlocked position. The switch lock 76 can be mounted on either the face 18 or back 20 of wrench body 12. The switch lock 76 includes a switch nub 78 that may or may not include nub ridges 80 for easily gripping and sliding switch lock 76. Switch lock 76 further includes an engaging end 82 for engaging or interfacing with thumbwheel 58. As shown, the engaging end 82 of switch lock 76 correspondingly aligns with a circular groove 84 that is formed within the bottom surface of thumbwheel 58.

As illustrated in FIG. 6, switch lock 76 is moved to a locked position. Switch lock 76 is slid in the general direction of locking arrow 86, where the engaging end 82 is removably inserted within circular groove 84 of thumbwheel 58, thus locking thumbwheel 58 in place. It will be understood that the engaging end 82 of the switch lock 76 may comprise different sizes, length, depths, or shapes. In addition, the engaging end 82 may include material having a coefficient of friction that allows the engaging end 82 to sit firmly within circular groove 84 of thumbwheel 58 thereby preventing the thumbwheel 60 from rotating.

Figure 7:
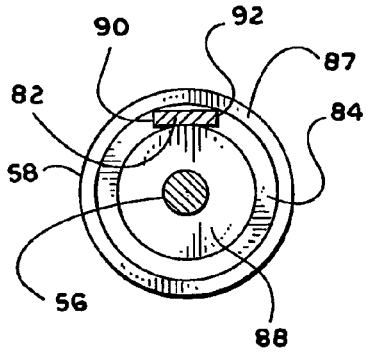
FIG. 7 is a bottom view of a thumbwheel, according to an alternative embodiment of the present invention.

Referring to FIG. 7, there is shown a bottom view of thumbwheel 58 including a cross-section view of the engaging end 82, which is shown firmly inserted within circular groove 84. Circular groove 84 defines an outer diameter 87 and an inner diameter 88. The depth and diameter of the circular groove 84 is configured to securely receive engaging end 82. When the engaging end 82 is inserted tangently within circular groove 84, the edges 90, 92 of the engaging end 82 abut firmly against the arch of the outer diameter 86 wall, thereby preventing thumbwheel 58 from rotating. Advantageously, thumbwheel 58 may be locked in any radial position, as a result of the groove 84 being formed in a circular pattern within the bottom surface of thumbwheel 58.

It will be understood that the means for locking 76 may comprise a slideable bar, slide pin, sliding or rotating levers, spring loaded pins, adjustable stops, keys, screws, bolts, detents, cams, or any movable piece located at any position on adjustable wrench 10 that, when moved into a locked position, interfaces with the means for braking 54 or any part thereof.

Figure 8:
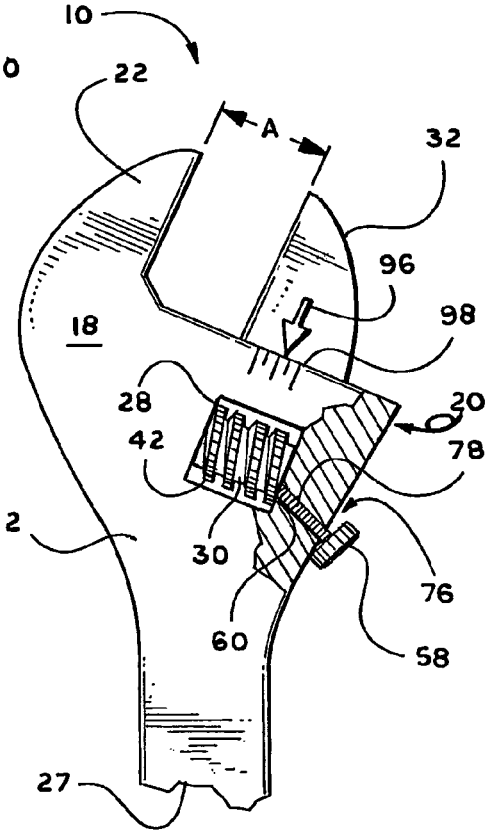
FIG. 8 shows an adjustable wrench, including a means for locking interfacing with a means for braking in partial cross-section, according to one embodiment of the present invention.

Referring now to FIG. 8, there is shown a partial cross-section view of an assembled adjustable wrench 10, including a means for locking that comprises a switch lock 76. As illustrated, the means for braking 54 is inserted within receiving channel 52 so that friction stop 60 interfaces with the knurl 30 or worm 42. In this exemplary embodiment, switch lock 76 is mounted on the back 20 of the adjustable wrench 10, near the means for braking 54. Here, the switch lock 76 is in a locked position where the engaging end 82 of switch lock 76 is fully inserted within the circular groove 84 of thumbwheel 58, thus preventing thumbwheel 58 from rotating. To unlock thumbwheel 58, a user slides switch lock 76 away from thumbwheel 58 by applying pressure to switch nub 78 in the direction opposite locking arrow 86. The engaging end 82 of the switch lock 76 is removed from circular groove 84, allowing a user to rotate thumbwheel 58 to adjust the means for braking 54. It will be noted that switch lock 76 can be oriented anywhere on wrench body 12 including a vertical, diagonal, horizontal or angled position to interface with the means for braking 54.

It will be understood that the adjustable wrench 10 may comprise any shape or size, and may include durable material such as metal, iron, aluminum, plastic, or any combination thereof. Further, the adjustable wrench 10 may include a protective sheath or covering that encases or covers all or part of the wrench body 12, including the handle 27, stationary jaw 22, and adjustable jaw 32. In addition, the adjustable wrench 10 may further include an indicator 96 mounted on adjustable jaw 32 that correspondingly aligns with markings 98. The markings 98 be in any language and may represent any one of metric or standard sizes, units, symbols, measurements, or any combination thereof. For example, the markings 98 may represent nut or bolt sizes, such as, inches, centimeters, or millimeters. The indicator 96 and markings 98 conveniently allow a user to preset the space A of the adjustable wrench 10 to accommodate the size of a nut or bolt. The adjustable jaw 32 is then locked to the preset space A with the means for braking 54. The means for locking 70, 76 may be subsequently moved to engage with the means for braking 54 prior to engaging with a nut or bolt.

It must be emphasized that the law does not require and it is economically prohibitive to illustrate and teach every possible embodiment of the present claims. Hence, the above-described embodiments are merely exemplary illustrations of implementations set forth for a clear understanding of the principles of the invention. Many variations and modifications may be made to the above-described embodiments without departing from the scope of the claims. All such modifications, combinations, and variations are included herein by the scope of this disclosure and the following claims.

I claim:

1. An adjustable wrench comprising:

a stationary jaw integrally formed with a body, said body including a recess and a handle;

a knurl including a worm, said knurl being rotatably mounted on an axle within said recess;

an adjustable jaw including a plurality of teeth meshing with said worm where rotation of said knurl imparts movement to said adjustable jaw;

a receiving channel formed at an angle to said knurl, said receiving channel extending through said body into said recess, and said receiving channel including a plurality of threads; and means for braking inserted within said receiving channel and removably engaging with one of said knurl and worm for restricting said adjustable jaw from moving.

2. The adjustable wrench of claim 1, wherein said means for braking comprises a screw including a thumbwheel and a friction stop.

3. The adjustable wrench of claim 2, wherein said friction stop includes a diameter larger than a diameter of said receiving channel.

4. The adjustable wrench of claim 2, further comprising a means for locking positioned on said body and selectively interfacing with said thumbwheel.

5. The adjustable wrench of claim 4, wherein said thumbwheel includes a circular groove defining an outer diameter and an inner diameter.

6. The adjustable wrench of claim 5, wherein said means for locking is configured to be removably inserted within said circular groove.

7. The adjustable wrench of claim 4, wherein said means for locking includes a lock wedge having an edge, said edge selectively interfacing with said thumbwheel.

8. The adjustable wrench of claim 4, further including markings and an indicator, one of each disposed on one of said body and said adjustable jaw, said markings being aligned with said indicator for indicating the distance between said stationary jaw and said adjustable jaw.

9. An adjustable wrench comprising:

a body including a stationary jaw, a recess and a handle;

a knurl including a worm, said knurl being rotatably mounted on an axle within said recess;

an adjustable jaw including a plurality of teeth engaging with said worm where rotation of said knurl imparts movement to said adjustable jaw;

a threaded channel formed at an angle to said knurl, said threaded channel extending through one side of said body into said recess;

a screw inserted within said threaded channel, said screw removably engaging with said worm for restricting said worm from moving; and a lock selectively engaged with said screw for restricting said screw from rotating.

10. The adjustable wrench of claim 9, wherein said screw includes a thumbwheel and a friction stop.

11. The adjustable wrench of claim 10, wherein said friction stop includes a diameter larger then a diameter of said threaded channel.

12. The adjustable wrench of claim 10, wherein said thumbwheel includes a circular groove defining an outer diameter and an inner diameter.

13. The adjustable wrench of claim 12, wherein said lock is removably inserted within said circular groove.

14. The adjustable wrench of claim 13, wherein said lock includes a lock wedge having an edge, said edge selectively interfacing with said thumbwheel.

15. The adjustable wrench of claim 9, further including markings and an indicator, one of each disposed on one of said body and said adjustable jaw, said markings being aligned with said indicator for indicating the distance between the stationary jaw and said adjustable jaw.

16. A method of using an adjustable wrench, comprising the steps of:

providing an adjustable wrench that includes a knurl, adjustable jaw, stationary jaw, a receiving channel formed at an oblique angle to said knurl, and means for braking positioned within said receiving channel;

placing said adjustable wrench in the hand of user;

rotating said knurl with at least one of a thumb and a finger of said user's hand, to set a distance between said adjustable jaw and said stationary jaw;

engaging said means for braking with said knurl using at least one of said thumb and said finger for preventing movement of said adjustable jaw; and interfacing means for locking with said means for braking using at least one of said thumb and said finger.

17. The method of claim 16, wherein said step of engaging comprises moving said means for braking with one of said thumb and said finger.

* * * * *